US010024019B1

(12) United States Patent
Hunter

(10) Patent No.: US 10,024,019 B1
(45) Date of Patent: Jul. 17, 2018

(54) COUPLER DEVICE FOR HELICAL PILE

(71) Applicant: Steven Edward Hunter, Wichita, KS (US)

(72) Inventor: Steven Edward Hunter, Wichita, KS (US)

( * ) Notice: Subject to any disclaimer, the term of this patent is extended or adjusted under 35 U.S.C. 154(b) by 0 days.

(21) Appl. No.: 15/796,477

(22) Filed: Oct. 27, 2017

(51) Int. Cl.
*E02D 5/24* (2006.01)
*E02D 5/52* (2006.01)
*E02D 5/56* (2006.01)
*E02D 7/22* (2006.01)

(52) U.S. Cl.
CPC ..... *E02D 5/526* (2013.01); *E02D 5/56* (2013.01); *E02D 7/22* (2013.01); *E02D 5/24* (2013.01); *E02D 2600/20* (2013.01)

(58) Field of Classification Search
USPC ..... 405/250, 251, 252.1
See application file for complete search history.

(56) References Cited

U.S. PATENT DOCUMENTS 4,099,585 A * 7/1978 Emmerich ..... E21B 10/38 175/320
6,516,904 B1 * 2/2003 Rein, Sr. ..... E21B 17/00 175/320
6,533,049 B1 * 3/2003 Rein, Sr. ..... E21B 17/00 175/320
7,699,119 B1 * 4/2010 Lunde ..... E21B 17/046 175/18
8,777,520 B2 * 7/2014 Lin ..... E02D 5/523 405/229
9,068,318 B1 * 6/2015 Gochis ..... E02D 5/56
9,589,134 B2 * 3/2017 Tripp ..... G06F 21/12
2017/0159256 A1 * 6/2017 Li ..... E02D 5/526

* cited by examiner

*Primary Examiner* — Kyle Armstrong
(74) *Attorney, Agent, or Firm* — Hovey Williams LLP

(57) ABSTRACT

A helical pile coupler assembly is operable to be drivingly attached to a helical pile section and is rotatable with the helical pile section about a coupler axis. The coupler assembly is operable to transfer torque supplied by a rotating drive to the helical pile section as the helical pile section is driven through the ground. The coupler assembly includes male and female couplers that define a projection and a socket, respectively. The male and female couplers are shiftable relative to each other along the coupler axis into and out of a mated condition where the projection and socket are mated so that the couplers drivingly engage each other and are configured to transfer torque therebetween. The socket is shaped to removably receive the projection in the mated condition. The projection presents a projection surface that extends along the coupler axis and defines a projection profile with only three radial lobes, with each of the lobes extending radially outwardly relative to the axis in corresponding radial directions.

21 Claims, 4 Drawing Sheets

COUPLER DEVICE FOR HELICAL PILE

BACKGROUND

1. Field

The present invention relates generally to pile structures. More specifically, embodiments of the present invention concern a coupler assembly for use with a helical pile to transmit torque as the helical pile is driven through the ground.

2. Discussion of Prior Art

Conventional helical piles are commonly installed as part of a new structural foundation (e.g., foundations associated with residential or commercial buildings). Helical piles are also frequently installed to repair and/or reinforce an existing structural foundation. Prior art helical piles include a tubular body and one or more helical blades fixed to the tubular body. The helical blade is configured to drive the pile into and out of the ground as the pile is rotated in corresponding directions about a pile axis.

In some instances, the tubular body of a conventional helical pile includes multiple tube sections that are removably connected end-to-end to increase the length of the pile. The tube sections have male and female tube ends that are removably attached to each other with a pin-shaped fastener that extends transversely through both tube ends.

However, prior art helical piles have various deficiencies. For example, the tube ends of known helical piles are prone to deformation or failure when subjected to excessive torque loading. In some instances, excessive torque loading can also cause deformation or failure of fasteners used to secure conventional tube ends together.

SUMMARY

The following brief summary is provided to indicate the nature of the subject matter disclosed herein. While certain aspects of the present invention are described below, the summary is not intended to limit the scope of the present invention.

Embodiments of the present invention provide a helical pile and coupler assembly that do not suffer from the problems and limitations of the prior art helical piles set forth above.

A first aspect of the present invention concerns a helical pile coupler assembly operable to be drivingly attached to a helical pile section and rotatable with the helical pile section about a coupler axis. The coupler assembly is operable to transfer torque supplied by a rotating drive to the helical pile section as the helical pile section is driven through the ground. The helical pile coupler assembly broadly includes male and female couplers. The male and female couplers define a projection and a socket, respectively. The couplers are shiftable relative to each other along the coupler axis into and out of a mated condition where the projection and socket are mated so that the couplers drivingly engage each other and are configured to transfer torque therebetween. The socket is shaped to removably receive the projection in the mated condition. The projection presents a projection surface that extends along the coupler axis and defines a projection profile with only three radial lobes, with each of said lobes extending radially outwardly relative to the axis in corresponding radial directions.

A second aspect of the present invention concerns a helical pile operable to be driven into the ground by a rotating drive. The helical pile broadly includes a helical pile section and a coupler assembly. The coupler assembly is drivingly attached to the helical pile section and is rotatable with the helical pile section about a coupler axis. The coupler assembly is operable to transfer torque supplied by the rotating drive to the helical pile section as the helical pile section is driven through the ground. The coupler assembly broadly includes male and female couplers. The male and female couplers define a projection and a socket, respectively. The male and female couplers are shiftable along the coupler axis into and out of a mated condition where the projection and socket are mated so that the couplers drivingly engage each other and are configured to transfer torque therebetween. The socket is shaped to slidably receive the projection in the mated condition. The projection presents a projection surface that extends along the coupler axis and defines a projection profile with only three radial lobes, with each of the lobes extending radially outwardly relative to the axis in corresponding radial directions.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 1:
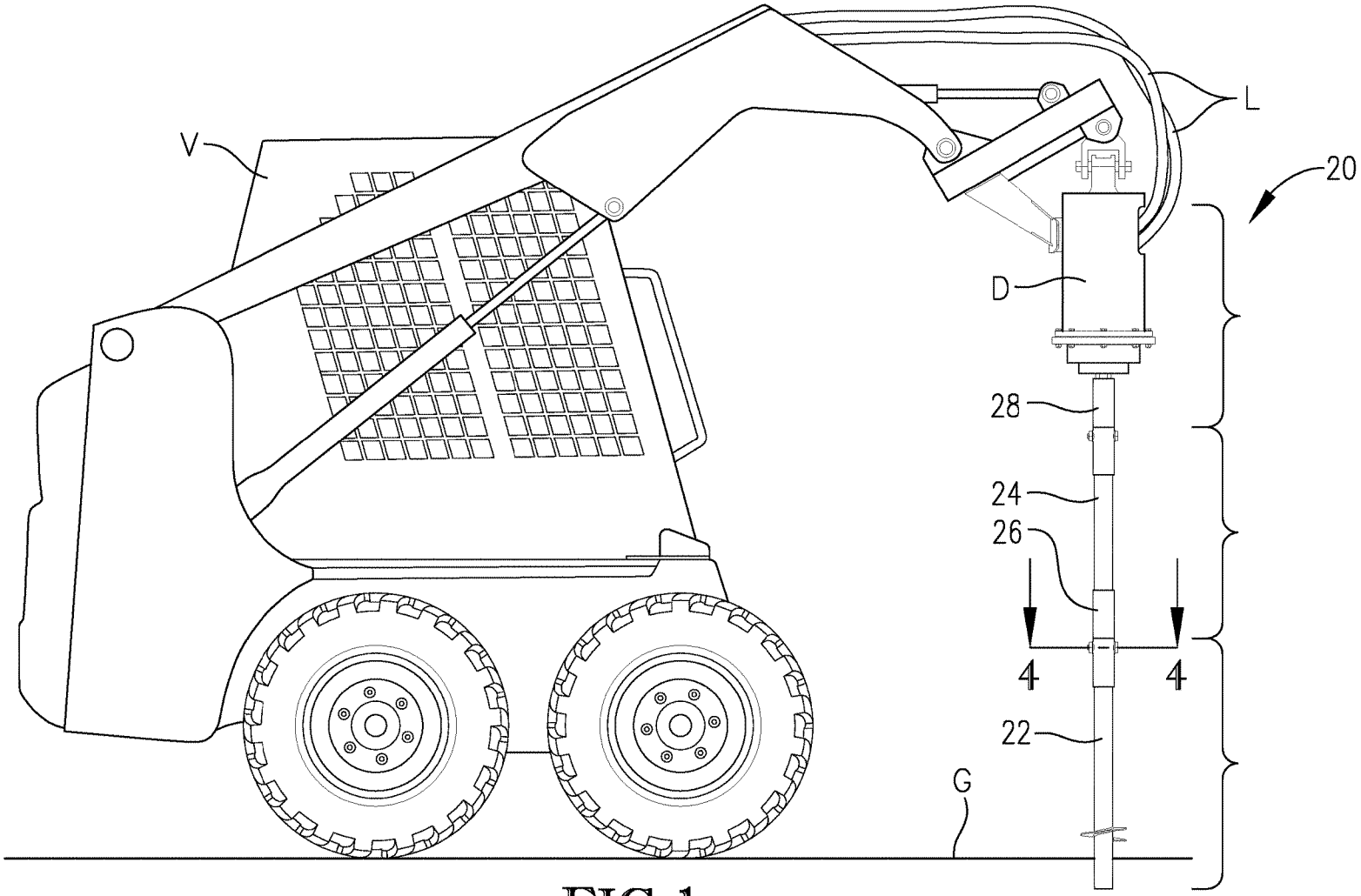
FIG. 1 is a side elevation of a helical pile constructed in accordance with a preferred embodiment of the present invention, showing a vehicle and a rotating drive used to drive the pile through the ground.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1, a helical pile 20 is operable to be driven into the ground by a rotating drive D. In the usual manner, the helical pile 20 is driven into and out of the ground G by rotating the helical pile 20, in respective directions D1,D2 (see FIG. 2), about a longitudinal pile axis. As with other conventional pile structures, the helical pile 20 can be used to reinforce a residential foundation (not shown). However, it is equally within the ambit of the present invention where the helical pile 20 is installed to reinforce various structures, such as a commercial building foundation.

As will be discussed in greater detail, the helical pile 20 includes coupler assemblies that each provide a resilient joint to transmit torque along the pile 20. The helical pile 20 preferably includes a pile lead section 22, a pile extension section 24, and coupler assemblies 26,28.

The helical pile 20 is operable to be driven into and out of the ground by the rotating drive D. The rotating drive D preferably includes a hydraulically-powered torque motor and a drive shaft S (see FIG. 2). The drive D is operably mounted on the lift mechanism of a vehicle V (see FIG. 1) and is powered by supplying pressurized hydraulic fluid from a hydraulic pump (not shown) of the vehicle V to the drive D via hydraulic lines L. It is also within the ambit of the present invention where an alternative rotating drive is used to shift the pile 20 into and out of the ground. For instance, the rotating drive could include an electric motor or an internal combustion engine.

Turning to FIGS. 1-7, the lead section 22 is configured to be driven into and out of the ground G by rotating the lead section 22 in respective directions D1,D2 about the pile axis. The lead section 22 preferably includes a unitary tubular shaft 30 and a helical blade 32 fixed to the shaft 30 (see FIGS. 2 and 5). The depicted shaft 30 presents an upper end 34 and a pointed lower end 36 with an angled edge configured to penetrate the ground G (see FIG. 2).

The helical blade 32 is preferably unitary and extends one full revolution around the shaft 30 so that the blade 32 does not overlap itself. However, the blade 32 could be alternatively configured without departing from the scope of the present invention. For instance, the blade 32 could make either more than one revolution or less than one revolution about the shaft 30. Also, the blade 32 could comprise a series of discrete blade segments (e.g., where the blade segments are spaced axially and/or circumferentially from one another).

The illustrated blade 32 is preferably fixed to the shaft 30 at a location adjacent the lower end 36 to move the lead section 22 through the ground. That is, the blade 32 is located closer to the lowermost end 36 than the upper end 34. It will be understood that the blade 32 could be variously positioned along the length of the shaft 30. Although the lead section 22 includes a single blade 32, the principles of the present invention are applicable where multiple blades are spaced along the length of the shaft.

The extension section 24 is configured to be removably attached relative to the lead section 22. When the sections 22,24 are attached relative to one another, the sections 22,24 rotate with each other and can be driven into and out of the ground G with each other. The extension section 24 preferably includes a unitary tubular shaft 38 that presents an upper end 40 and a lower end 42 (see FIG. 2). The depicted extension section 24 does not include a helical blade to drive the section 24 through the ground. However, for some aspects of the present invention, the extension section 24 could include one or more such helical blades.

The helical pile 20 preferably includes a single lead section 22 and a single extension section 24 so that the pile 20 is of suitable length for installation. However, the pile could include an alternative number of lead sections and/or an alternative number of extension sections without departing from the scope of the present invention. For instance, the helical pile could include only a single lead section and be devoid of an extension section. On the other hand, it will be appreciated that the helical pile could be formed with more than two pile sections (e.g., where the helical pile includes two or more extension sections attached in series above the lead section).

As explained below, the coupler assemblies 26,28 include couplers that are preferably fixed to corresponding ends of the sections 22,24. It is also within the ambit of the present invention where one or both of the sections 22,24 is removably attached to the corresponding coupler. Furthermore, at least one of the couplers could be integrally formed as part of the corresponding section 22,24.

Figure 4:
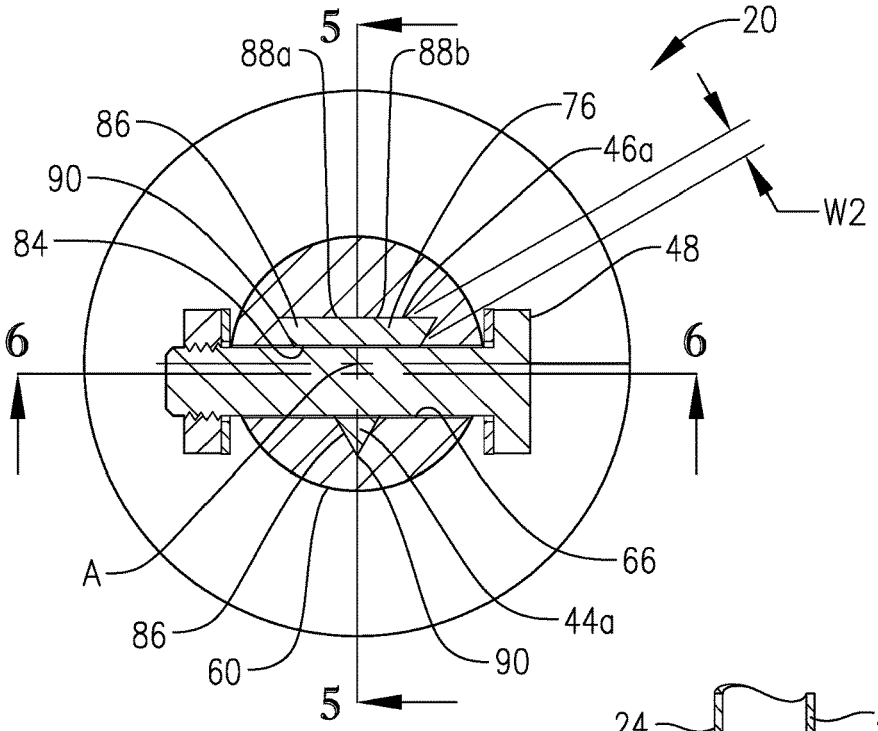
FIG. 4 is a cross section of the helical pile taken along line 4-4 in FIG. 1, showing a fastener connecting a pair of male and female couplers.

Each coupler assembly 26,28 is operable to be drivingly attached to at least one of the sections 22,24 and is rotatable therewith about a coupler axis A (see FIG. 4). The coupler assemblies are preferably arranged so that the coupler axis A of each coupler assembly is substantially coaxial with the pile axis.

Each coupler assembly 26,28 is preferably configured to transfer torque supplied by the rotating drive D to a corresponding section as the helical pile 20 is driven through the ground G. The illustrated coupler assemblies 26,28 preferably include respective male couplers 44*a,b*, female couplers 46*a,b*, and removable threaded fasteners 48 (see FIG. 2).

In the illustrated embodiment, the female couplers 46*a,b* are substantially identical to one another. Preferably, each female coupler 46 has a unitary construction and is configured to be mated with the corresponding male coupler 44. When mated with one another, the couplers 44,46 are drivingly engaged so that the couplers 44,46 can transfer torque therebetween. Each female coupler 46 preferably includes a mounting portion 50 and a female coupler end portion 52 (see FIGS. 5 and 6).

Figure 5:
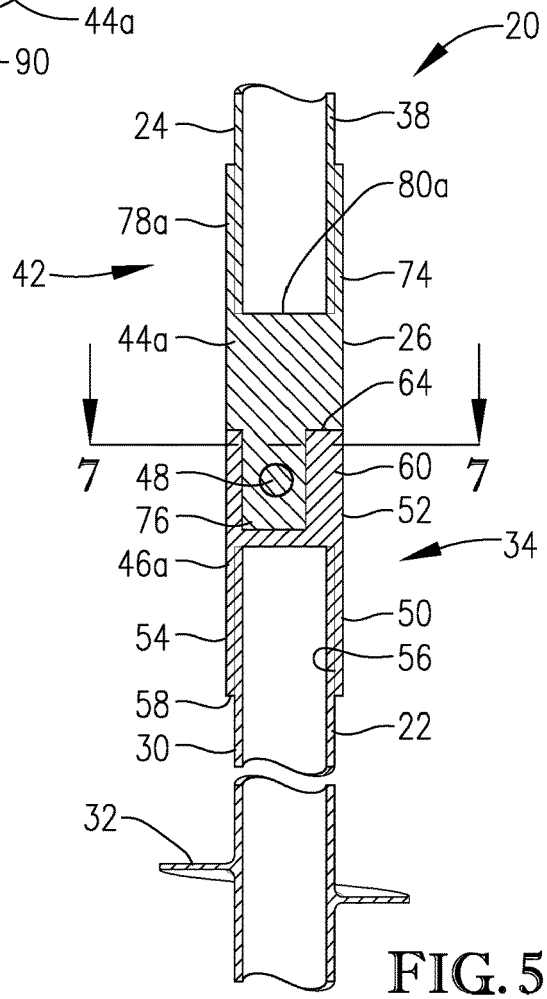
FIG. 5 is a cross section of the helical pile taken along line 5-5 in FIG. 4.
Figure 6:
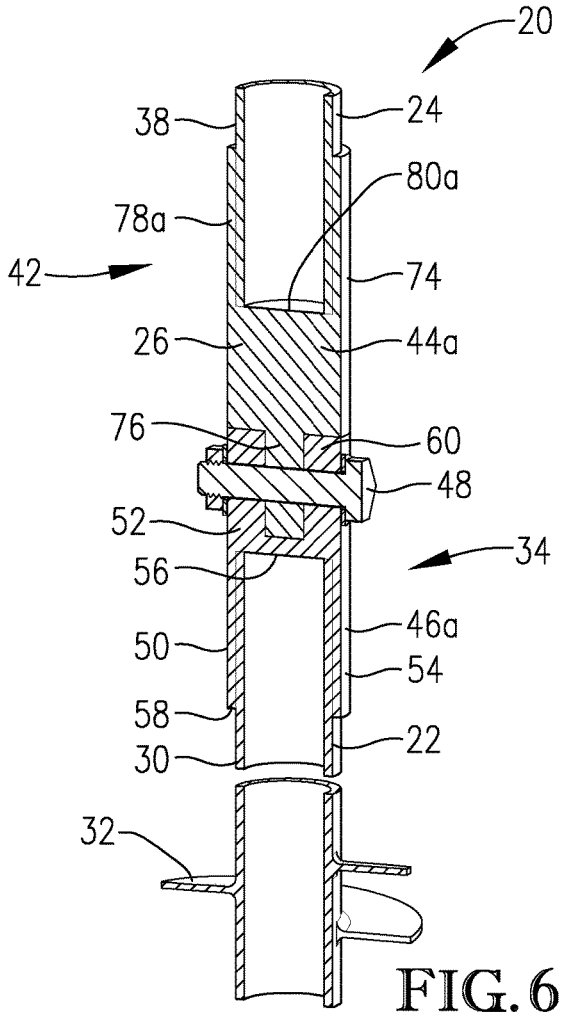
FIG. 6 is a cross section of the helical pile taken along line 6-6 in FIG. 4.

Turning to FIGS. 5 and 6, the mounting portion 50 preferably includes an endless tubular mounting sleeve 54 that forms a cylindrical socket 56 to receive the upper end of the respective pile section 22,24. The mounting portion 50 is preferably fixed to the pile section 22,24 by welding the mounting portion 50 to the pile section along an end margin 58 of the sleeve 54. However, the mounting portion could be alternatively attached to pile section 22,24 (e.g., where the mounting portion and pile section are alternatively welded, adhered, or fastened together with one or more fasteners). It is also within the scope of the present invention where the female coupler 46 is integrally formed with the respective pile section 22,24 so that no mounting portion is required.

The principles of the present invention are also applicable where the mounting portion 50 is alternatively shaped to engage the pile section 22,24. For instance, the mounting portion could present a male element that is slidably received within the tubular passage of the pile section. The mounting portion could also include both male and female elements that slidably engage the end of the pile section.

Figure 2:
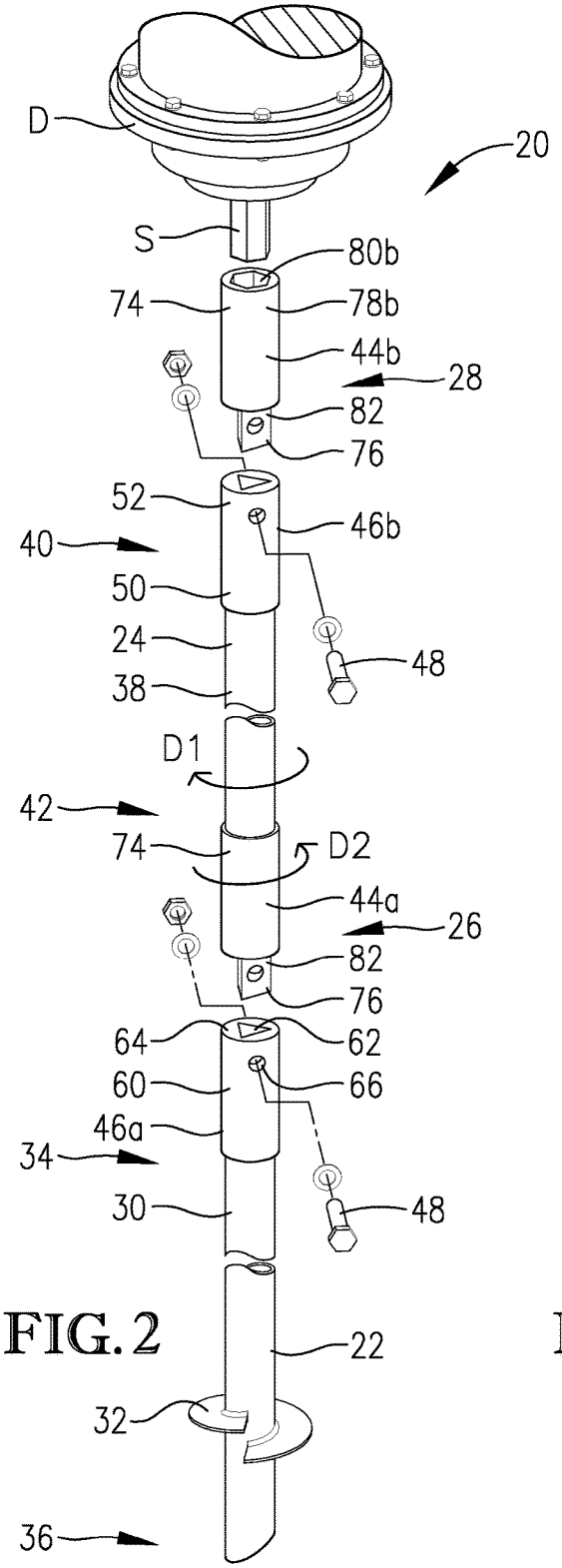
FIG. 2 is a fragmentary upper perspective of the helical pile and rotating drive shown in FIG. 1, showing a lead section and extension section of the pile connected to coupler assemblies, with the coupler assemblies being exploded to show male and female couplers and fasteners of each coupler assembly.
Figure 7:
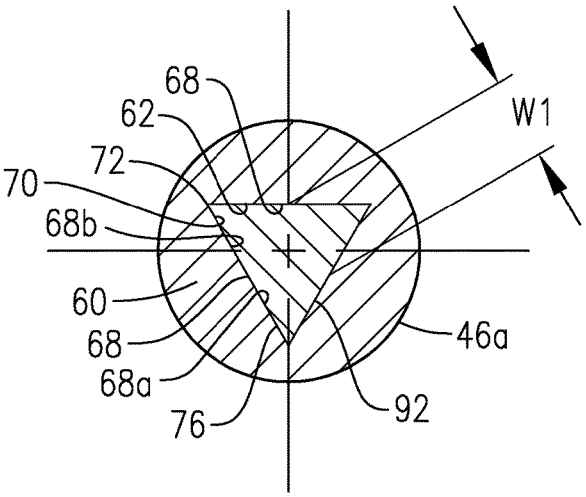
FIG. 7 is a cross section of the helical pile taken along line 7-7 in FIG. 5.

Turning to FIGS. 2-7, the female coupler end portion 52 preferably includes an endless socket sleeve 60 that defines a coupling socket 62 (see FIGS. 2 and 7). The coupling socket 62 extends from an end margin 64 of the sleeve 60 along the coupler axis A. It is also within the scope of the present invention where the sleeve 60 has an alternative configuration. For some aspects of the present invention, the socket sleeve could include one or more portions that present circumferentially spaced apart ends so that the sleeve is not endless.

The coupler end portion 52 also preferably presents a bore 66 that extends through the socket sleeve 60 in a direction perpendicular to the coupler axis A. As will be discussed, the bore 66 is configured to receive the fastener 48.

The socket 62 presents socket side surfaces 68 (see FIG. 7) that extend along the coupler axis A and define a socket profile. As will be explained, the socket profile is preferably complementally shaped relative to a projection profile of the male coupler 44.

The socket profile preferably includes only three radial slot portions 70 (see FIG. 7). Each of the slot portions 70 extends radially outwardly relative to the coupler axis A in corresponding radial directions. In the depicted embodiment, each slot portion 70 is defined by a pair of side surfaces 68 that extend radially outwardly to a radially outermost slot end 72.

More preferably, the socket profile has a triangular shape where the side surfaces 68 of each slot portion 70 extend radially outwardly to form a vertex at the radially outermost slot end 72, with the side surfaces 68 extending from the vertex to define an acute angle. Each adjacent pair of slot portions 70 share a common side surface 68 that is substantially planar and continuous. In the illustrated embodiment, each common side surface extends continuously between a corresponding pair of adjacent slot ends 72. Furthermore, each common side surface 68 includes adjacent side surface portions 68*a,b* (see FIG. 7) that form an interior angle of about one hundred eighty degrees (180°).

However, the principles of the present invention are applicable where the socket profile presents an alternative shape with three slot portions. For instance, the common side surface shared by adjacent slot portions 70 could include multiple adjacent side surface portions that extend between adjacent slot ends. In one alternative embodiment, an adjacent pair of side surface portions could be arranged at an oblique angle to one another, where the socket profile defines a three-lobed star shape. That is, the socket profile could have a concave polygonal shape where the adjacent side surface portions define an interior angle greater than one hundred eighty degrees (180°).

The side surfaces 68 of at least one slot portion 70 could also be joined by an intermediate end surface at the outermost slot end. For instance, at least one of the slot portions could include a straight end surface between the respective side surfaces so that the side surfaces do not intersect each other at a vertex (e.g., where the slot portion has a trapezoidal shape). It will also be appreciated that at least one slot profile could present a curvilinear shape. For instance, the outermost slot end of at least one slot profile could be rounded.

The illustrated slot profile preferably presents a slot width dimension W1 (see FIG. 7) transverse to the radial direction. The width dimension W1 of the slot portions 70 preferably tapers in a radially outward direction. However, the shape of one or more of the slot portions could present an alternative width along its length. For instance, the slot portion could include a constant width section. Furthermore, at least part of the slot portion could taper in a radially inward direction. Yet further, the slot portion could include multiple sections that taper in the radially outward direction and/or the radially inward direction.

The slot portions preferably have slot profiles that are each substantially symmetrical about the corresponding slot axis and substantially identical to each other. Furthermore, the socket profile is also substantially symmetrical. However, the principles of the present invention are applicable where one or more of the slot profiles is not symmetrical. It will also be appreciated that the socket profile may not have an axis of symmetry consistent with the principles of the present invention.

For some aspects of the present invention, the socket profile could include an alternative number of slot portions. For instance, the socket profile could present a single slot portion or a pair of slot portions. In another such alternative embodiment, the projection could have more than three slot portions.

The socket profile preferably has a shape and orientation that is constant along the coupler axis A. It is also within the scope of the present invention where the socket profile varies along the coupler axis A. For instance, the socket profile could taper in a direction away from the end margin 64, provided that the projection has a complemental taper shape to permit removable engagement between the male and female couplers 44,46.

Referring again to FIGS. 2-7, the male coupler 44 has a unitary construction and is configured to be mated with the female coupler 46. When mated with one another, the couplers 44,46 are drivingly engaged so that the couplers 44,46 can transfer torque therebetween. Each male coupler 44 preferably includes a mounting portion 74 and a male coupler end portion 76.

Turning to FIGS. 5 and 6, the mounting portion 74 of male coupler 44*a* preferably includes an endless tubular sleeve 78*a* that forms a cylindrical socket 80*a* to receive an end of the section 22. The mounting portion 74 of male coupler 44*a* is preferably fixed to the section 22 by welding the mounting portion 74 and pile section 22 together along an end margin of the sleeve 78*a*. However, the male coupler 44*a* and pile section 22 could be alternatively attached to one another (e.g., where the male coupler 44*a* and pile section 22 are alternatively welded, adhered, or fastened together with one or more fasteners). It is also within the scope of the present invention where the male coupler 44*a* and pile section 22 are integrally formed with each other so that no mounting portion is required.

The principles of the present invention are also applicable where the mounting portion 74 of the male coupler 44*a* is alternatively shaped to engage the pile section 22. For instance, the mounting portion could present a male element that is slidably received within the tubular passage of the pile section. The mounting section could also include both male and female elements that slidably engage the end of the pile section.

Similarly, the mounting portion 74 of male coupler 44*b* preferably includes an endless tubular sleeve 78*b* that forms a socket 80*b* (see FIG. 2). The socket 80*b* and drive shaft S are complementally shaped so that the socket 80*b* can slidably receive the drive shaft S (see FIG. 2). The male coupler 44*b* is preferably removably attached to the drive shaft S. The male coupler 44*b* and drive shaft S are slidable into and out of driving engagement with one another along the coupler axis A.

The principles of the present invention are also applicable where the mounting portion 74 of the male coupler 44*b* is alternatively shaped to engage the drive shaft S. For instance, the mounting portion could present a male element that is slidably received within the tubular passage of the drive shaft. The mounting section could also include both male and female elements that slidably engage the drive shaft.

Figure 3:
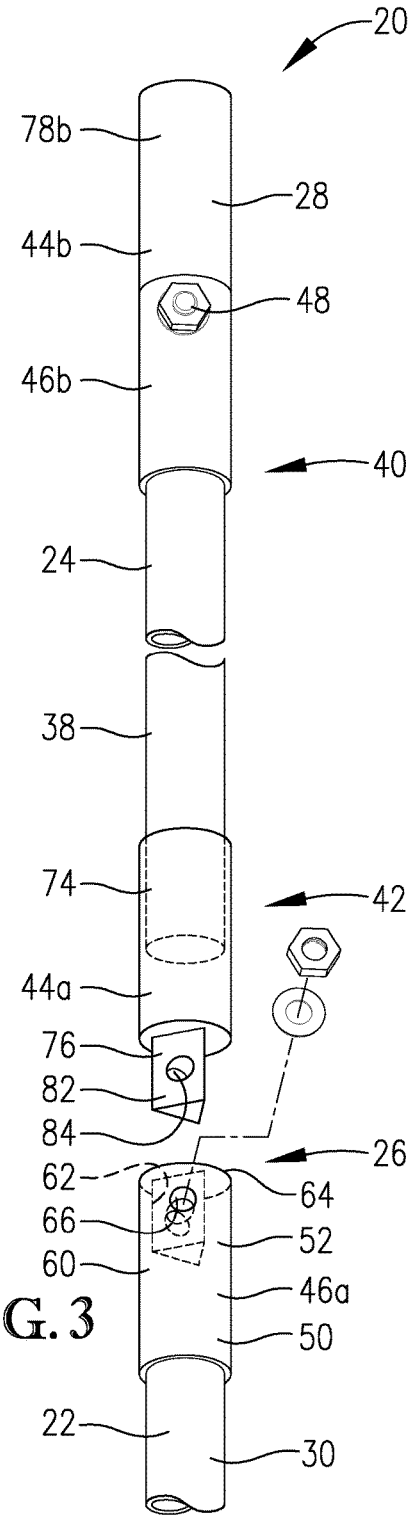
FIG. 3 is a fragmentary lower perspective of the helical pile shown in FIGS. 1 and 2.

The male coupler end portion 76 preferably includes a unitary projection 82 that extends along the coupler axis A (see FIGS. 2 and 3). However, for some aspects of the present invention, the projection could include one or more sections so that the projection is not unitary.

The coupler end section 76 also preferably presents a bore 84 that extends through the projection 82 in a direction perpendicular to the coupler axis A (see FIGS. 3 and 4). As will be discussed, the bore 84 is configured to be aligned with the bore 66 so that the bores 66,84 cooperatively receive the fastener 48 (see FIG. 4).

The projection 82 includes three (3) lobes 86 that present lobe side surfaces 88 (see FIG. 4). The side surfaces 88 extend along the coupler axis A and define a projection profile. Again, the projection profile of the male coupler 44 is preferably complementally shaped relative to the socket profile of the female coupler 46.

The projection profile preferably includes only three radial lobes 86. Each of the lobes 86 extends radially outwardly relative to the coupler axis A in corresponding radial directions. Each lobe 86 is defined by a pair of side surfaces 88 that extend radially outwardly to a radially outermost lobe end 90.

More preferably, the projection profile has a triangular shape where the side surfaces 88 of each lobe 86 extend radially outwardly to form a vertex at the radially outermost lobe end 90 (see FIG. 4). Each adjacent pair of lobes 86 share a common side surface 88 that is substantially planar and continuous. In the illustrated embodiment, each common side surface 88 extends continuously a corresponding pair of lobe ends 90. Each common side surface 88 includes adjacent side surface portions 88*a,b* (see FIG. 4) that form an exterior angle of about one hundred eighty degrees (180°).

However, the principles of the present invention are applicable where the projection profile presents an alternative shape with three lobes. For instance, the common side surface shared by adjacent lobes 86 could include multiple adjacent side surface portions that extend between adjacent lobe ends. In one alternative embodiment, an adjacent pair of side surface portions could be arranged at an oblique angle to one another, where the projection profile defines a three-lobed star shape. That is, the projection profile could have a concave polygonal shape where the adjacent side surfaces of an adjacent pair of lobes could define an exterior angle less than one hundred eighty degrees (180°).

The side surfaces of at least one lobe 86 could also be joined by an intermediate end surface at the outermost lobe end 90. For instance, at least one of the lobes could include a straight end surface between the respective side surfaces so that the side surfaces do not intersect each other at a vertex (e.g., where the lobe has a trapezoidal shape). It will also be appreciated that at least one lobe could present a curvilinear shape. For instance, the outermost lobe end of at least one lobe profile could be rounded.

The illustrated lobe profile preferably presents a lobe width dimension W2 transverse to the radial direction (see FIG. 2). The width dimension W2 of the lobe profile preferably tapers in a radially outward direction. However, the shape of one or more of the lobe profiles could present an alternative width along its length. For instance, the lobe profile could include a constant width section. Furthermore, at least part of the lobe profile could taper in a radially inward direction. Yet further, the lobe profile could include multiple sections that taper in the radially outward direction and/or the radially inward direction.

The lobes 86 preferably have lobe profiles that are each substantially symmetrical about the lobe axis and substantially identical to each other. Furthermore, the projection profile is also substantially symmetrical. However, the principles of the present invention are applicable where one or more of the lobe profiles is not symmetrical. It will also be appreciated that the projection profile may not have an axis of symmetry consistent with the principles of the present invention.

For some aspects of the present invention, the projection profile could include an alternative number of lobes. For instance, the projection profile could present a single lobe or a pair of lobes. In another such alternative embodiment, the projection could have more than three lobes.

The projection profile preferably has a shape and orientation that is constant along the coupler axis A. However, it is within the scope of the present invention where the projection profile varies along the coupler axis A. For instance, the projection profile could taper in a direction toward the connector end, provided that the socket has a complemental taper shape to permit removable engagement between the male and female couplers 44,46.

The couplers 44,46 are preferably shiftable relative to each other along the coupler axis A into and out of a mated condition (see FIGS. 4-7). In the mated condition, the projection 82 and socket 62 are mated so that the couplers 44,46 drivingly engage each other and are configured to transfer torque therebetween. Also in the mated condition, the bores 66,84 are preferably substantially coaxially aligned.

In the depicted embodiment, the illustrated couplers 44,46 are preferably secured to one another in the mated condition with one of the threaded fasteners 48. In the mated condition, the coaxially aligned bores 66,84 permit the fastener 48 to be secured through both of the couplers 44,46.

The depicted fastener 48 preferably extends through the socket sleeve 60 and the projection 82. In the illustrated arrangement, the fastener 48 extends at least partly through each of the lobes 86. However, the fastener could be alternatively located to secure the projection 82 to the socket sleeve 60. For instance, the fastener could be offset to one side of the depicted location so that the fastener extends through only one of the lobes (e.g., where the projection presents a notch that slidably receives the fastener).

It is also within the scope of the present invention where an alternative structure is used to removably interconnect and secure the couplers 44,46 to one another. For instance, while the illustrated fastener 48 is preferred, an alternative pin structure could be located to extend through the bores 66,84 and thereby secure the couplers 44,46 in the mated condition.

In the illustrated embodiment, the fastener 48 generally does not transmit any torque about the coupler axis A between the couplers 44,46. That is, the socket sleeve 60 and projection 82 of the couplers 44,46 are configured to transmit the entire torque (about the coupler axis A) transmitted from one of the couplers to the other one of the couplers. However, it will be appreciated that the coupler assemblies could be configured so that some torque can be transmitted by the fastener between the couplers when driving the pile through the ground.

When mated, the socket side surfaces 68 and the lobe side surfaces 88 preferably engage one another to cooperatively define a coupler interface 92 along which the lobes 86 and socket 62 are engaged with one another. The depicted coupler interface 92 is operable to transmit substantially all torque about the axis A from one of the mated couplers 44,46 to the other of the mated couplers.

Most preferably, the socket profile is complementally shaped relative to the projection profile so that the coupler interface 92 extends substantially endlessly about the coupler axis A. However, for some aspects of the present invention, the mated couplers could be engaged so that only parts of the side surfaces of the mated couplers are engaged. For instance, it will be appreciated that only parts of the lobes engage the socket side surfaces.

In one such alternative embodiment, the side surfaces of the mated couplers could be drivingly engaged at locations adjacent the lobe ends 90 while being disengaged (i.e., spaced apart from each other) at locations spaced between adjacent pairs of lobe ends 90. For example, the projection could have a triangular profile while the socket has the profile of a six-pointed star.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A helical pile coupler assembly operable to be drivingly attached to a helical pile section and rotatable with the helical pile section about a coupler axis, said coupler assembly operable to transfer torque supplied by a rotating drive to the helical pile section as the helical pile section is driven through the ground, said helical pile coupler assembly comprising:

male and female couplers defining a projection and a socket, respectively, said male and female couplers being shiftable relative to each other along the coupler axis into and out of a mated condition where the projection and socket are mated so that the couplers drivingly engage each other and are configured to transfer torque therebetween, said socket being shaped to removably receive the projection in the mated condition, said projection presenting a projection surface that extends along the coupler axis and defines a projection profile with only three radial lobes, with each of said lobes extending radially outwardly relative to the axis in corresponding radial directions, each of said radial lobes including a pair of side surfaces that extend radially outwardly to a radially outermost lobe end, with the side surfaces converging toward each other in a radially outward direction; and an elongated pin releasably securing the couplers to one another in the mated condition to restrict relative sliding movement of the couplers along the axis, said elongated pin arranged transversely to the axis and extending through a first one of the radial lobes to intersect the corresponding side surfaces, with the elongated pin extending along the other radial lobes.

2. The helical pile coupler assembly as claimed in claim 1, said radially outermost end of each lobe forming a vertex, with the side surfaces defining an acute angle.

3. The helical pile coupler assembly as claimed in claim 2, said projection profile presenting a triangular shape.

4. The helical pile coupler assembly as claimed in claim 1, said lobes and said socket cooperatively defining a coupler interface along which the lobes and socket are engaged with one another, with the coupler interface operable to transmit substantially all torque from the rotating drive to the helical pile section.

5. The helical pile coupler assembly as claimed in claim 4, said socket presenting a socket surface that extends along the coupler axis and defines a socket profile, said socket profile being complementally shaped relative to the projection profile, with the surfaces engaging one another so that the coupler interface extends endlessly about the coupler axis.

6. The helical pile coupler assembly as claimed in claim 1, said female coupler including a socket sleeve that at least partly surrounds and defines the socket.

7. The helical pile coupler assembly as claimed in claim 6, said socket sleeve extending endlessly around the socket.

8. The helical pile coupler assembly as claimed in claim 7, said socket presenting a socket surface that extends along the coupler axis and defines a socket profile, said socket profile being complementally shaped relative to the projection profile, with the surfaces engaging one another so that the coupler interface extends endlessly about the coupler axis.

9. The helical pile coupler assembly as claimed in claim 1, said female coupler including a socket sleeve that at least partly surrounds and defines the socket, said elongated pin extending through the socket sleeve to engage the projection in the mated condition and thereby releasably secure the couplers to one another.

10. The helical pile coupler assembly as claimed in claim 9, said helical pile coupler being configured so that substantially no torque about the coupler axis is transmitted between the couplers by the pin element.

11. A helical pile operable to be driven into the ground by a rotating drive, said helical pile comprising:

a helical pile section; and a coupler assembly drivingly attached to the helical pile section and rotatable with the helical pile section about a coupler axis, said coupler assembly operable to transfer torque supplied by the rotating drive to the helical pile section as the helical pile section is driven through the ground, said coupler assembly including— male and female couplers defining a projection and a socket, respectively, said male and female couplers being shiftable along the coupler axis into and out of a mated condition where the projection and socket are mated so that the couplers drivingly engage each other and are configured to transfer torque therebetween, said socket being shaped to slidably receive the projection in the mated condition, said projection presenting a projection surface that extends along the coupler axis and defines a projection profile with only three radial lobes, with each of said lobes extending radially outwardly relative to the axis in corresponding radial directions, each of said radial lobes including a pair of side surfaces that extend radially outwardly to a radially outermost lobe end, with the side surfaces converging toward each other in a radially outward direction; and an elongated pin releasably securing the couplers to one another in the mated condition to restrict relative sliding movement of the couplers along the axis, said elongated pin arranged transversely to the axis and extending through a first one of the radial lobes to intersect the corresponding side surfaces, with the elongated pin extending along the other radial lobes.

12. The helical pile as claimed in claim 11, said radially outermost end of each lobe forming a vertex, with the side surfaces defining an acute angle.

13. The helical pile as claimed in claim 12, said projection profile presenting a triangular shape.

14. The helical pile as claimed in claim 11, said lobes and said socket cooperatively defining a coupler interface along which the lobes and socket are engaged with one another, with the coupler interface operable to transmit substantially all torque from the rotating drive to the helical pile section.

15. The helical pile as claimed in claim 14, said socket presenting a socket surface that extends along the coupler axis and defines a socket profile, said socket profile being complementally shaped relative to the projection profile, with the surfaces engaging one another so that the coupler interface extends endlessly about the coupler axis.

16. The helical pile as claimed in claim 11, said female coupler including a socket sleeve that at least partly surrounds and defines the socket.

17. The helical pile as claimed in claim 16, said socket sleeve extending endlessly around the socket.

18. The helical pile as claimed in claim 17, said socket presenting a socket surface that extends along the coupler axis and defines a socket profile, said socket profile being complementally shaped relative to the projection profile, with the surfaces engaging one another so that the coupler interface extends endlessly about the coupler axis.

19. The helical pile as claimed in claim 11, said female coupler including a socket sleeve that at least partly surrounds and defines the socket, said elongated pin element extending through the socket sleeve to engage the projection in the mated condition and thereby releasably secure the couplers to one another.

20. The helical pile as claimed in claim 19, said helical pile coupler being configured so that substantially no torque about the coupler axis is transmitted between the couplers by the pin element.

21. The helical pile as claimed in claim 11, further comprising:

a second helical pile section located proximally to the first-mentioned helical pile section, said female coupler being fixed to the first-mentioned helical pile section and said male coupler being fixed to the second helical pile section, with the couplers securing the helical pile sections relative to one another in the mated condition.

* * * * *